US006422872B1

(12) United States Patent
Outlaw

(10) Patent No.: US 6,422,872 B1
(45) Date of Patent: Jul. 23, 2002

(54) BATTING PRACTICE BALANCE PLATFORM

(76) Inventor: James F. Outlaw, Rte. 7, Box 7515, Palestine, TX (US) 75801

( * ) Notice: Subject to any disclaimer, the term of this patent is extended or adjusted under 35 U.S.C. 154(b) by 0 days.

(21) Appl. No.: 09/544,188

(22) Filed: Apr. 6, 2000

(51) Int. Cl.[7] ..... A63B 69/36

(52) U.S. Cl. ..... 434/247; 434/252; 473/279; 473/278; 473/270; 473/271; 473/272; 473/218

(58) Field of Search ..... 473/499–501, 473/414, 415–422, 257, 258, 266, 270–273, 278, 452, 218, 279; 434/252

(56) References Cited

U.S. PATENT DOCUMENTS 3,352,559 A * 11/1967 Larsen ..... 273/187 R
3,639,923 A * 2/1972 Stewart ..... 273/187 R
3,697,080 A * 10/1972 Liotta ..... 273/186 R
4,088,325 A * 5/1978 Sutton ..... 273/187 R
4,164,352 A * 8/1979 O'Brien ..... 273/187 A
4,921,254 A * 5/1990 Buckley et al. ..... 273/183 B
4,962,933 A * 10/1990 Awazu et al. ..... 273/186 C
5,000,457 A * 3/1991 Brown ..... 273/187 B
5,076,580 A * 12/1991 Lang ..... 273/26 R
5,163,686 A * 11/1992 Bergman ..... 273/187 A
5,263,863 A * 11/1993 Stefani et al. ..... 434/252
5,330,176 A * 7/1994 Cagney, Jr. ..... 273/26 R
5,577,916 A * 11/1996 Gordon ..... 434/252
5,607,150 A * 3/1997 Schnorr, III ..... 473/499
5,993,326 A * 11/1999 Hitchman et al. ..... 473/257
6,001,026 A 12/1999 Breneman

* cited by examiner

*Primary Examiner*—Derris H. Banks
*Assistant Examiner*—Dmitry Suhol
(74) *Attorney, Agent, or Firm*—Finnegan, Henderson, Farabow, Garrett & Dunner

(57) ABSTRACT

A balance platform for teaching a batter a desired shift in weight associated with the act of swinging a bat. The platform includes a calibrated support surface, a pivot leg connected to an underside of the support surface, and a support leg connected to the underside of the support surface at a rearward end thereof. When used to teach a batter to shift body weight an appropriate amount to achieve a predetermined weight distribution during the stride phase associated with a batting swing, the stance distance and average stride length of the batter is measured and is utilized to determine the desired positioning of the batter on the balance platform. The batter is thereafter positioned atop the balance platform such that a rear foot of the batter is positioned a predetermined distance behind the center of mass of the platform. When the batter thereafter conducts his or her stride, the platform provides the batter with a kinesthetic signal when the batter's weight distribution on the stride foot has exceeded a predetermined amount. In an alternate embodiment, the position of a weight on a tongue relative to the center of mass is determined prior to usage of the platform.

20 Claims, 3 Drawing Sheets

BATTING PRACTICE BALANCE PLATFORM

The present invention relates to training devices for learning the art of batting a ball. More particularly, the present invention relates to a balance platform for teaching a batter a desired shift in weight associated with the act of swinging a bat.

BACKGROUND OF THE INVENTION

The mechanics of properly hitting a pitched ball involve a number of coordinated movements of the batter's body. The mechanics typically include an initial stance in which the bat is held with the hands and arms in a desired position, the batter's head is turned toward the pitcher, and the batter's front foot (nearest the pitcher) and rear foot are spaced at a desired stance distance. In this initial stance position, the batter's weight typically varies from being evenly distributed between his or her feet to a majority of the weight on the rear foot. When the ball is pitched, the batter sees the ball and initiates a series of swing mechanics, which will hopefully cause the bat to strike the ball. The swing mechanics typically include a short stride or movement of the front foot toward the pitcher (often referred to as the stride phase of the swing) followed by the rotation of the bat about the batter's body.

Many coaches and hitting instructors believe the body weight distribution on the stride foot at the end of the stride phase is one of the most critical aspects in learning to properly and effectively hit a ball. If the percentage body weight distribution on the stride foot at the end of the stride phase (i.e., when the stride foot hits the ground) is incorrect, the desired rotation of the bat will be deficient or inadequate, resulting in an undesired striking action against the ball.

SUMMARY OF THE INVENTION

Accordingly, the present invention provides an apparatus and method for teaching or training a batter to achieve a preselected percentage body weight distribution on the stride foot at the end of the striding action. The apparatus and method may be used when practicing hitting mechanics and provide a kinesthetically based signal to the batter when the batter has exceeded a preselected body weight distribution on the stride foot at the end of the stride phase.

In one embodiment of the invention, a balance platform having a center of mass comprises a calibrated support surface, a pivot leg connected to an underside of the support surface, and a support leg connected to the underside of the support surface at a rearward end thereof. In such embodiment, an equation or chart is utilized for calculating the desired placement of a batter's rear foot atop the platform. In an alternate embodiment, the balance platform may include a tongue on either or both ends of the support surface adapted to receive an adjustment weight. In such embodiment, an equation or chart is utilized for calculating the desired placement of the adjustment weight on the tongue.

In the first embodiment, the method for teaching a batter to shift his or her body weight a predetermined amount during the stride phase of a batting swing comprises the steps of measuring the stance distance of the batter, measuring the average stride length of the batter, and determining or calculating from the stance distance and average stride length a desired positioning of the batter on the balance platform. The batter is thereafter positioned on the balance platform such that a rear foot of the batter is positioned a predetermined distance behind the center of mass of the platform. The batter thereafter conducts the striding action associated with his or her batting swing, with the platform providing the batter with a kinesthetic signal (a tilting or pivoting of the platform) when the batter's weight on the stride foot (due to weight shift) has exceeded the predetermined amount. In the alternate embodiment, an adjustment weight is properly positioned on a forward or rearward tongue and the batter's feet are evenly spaced from the center of mass.

DETAILED DESCRIPTION OF THE PREFERRED EMBODIMENT

Figure 1:
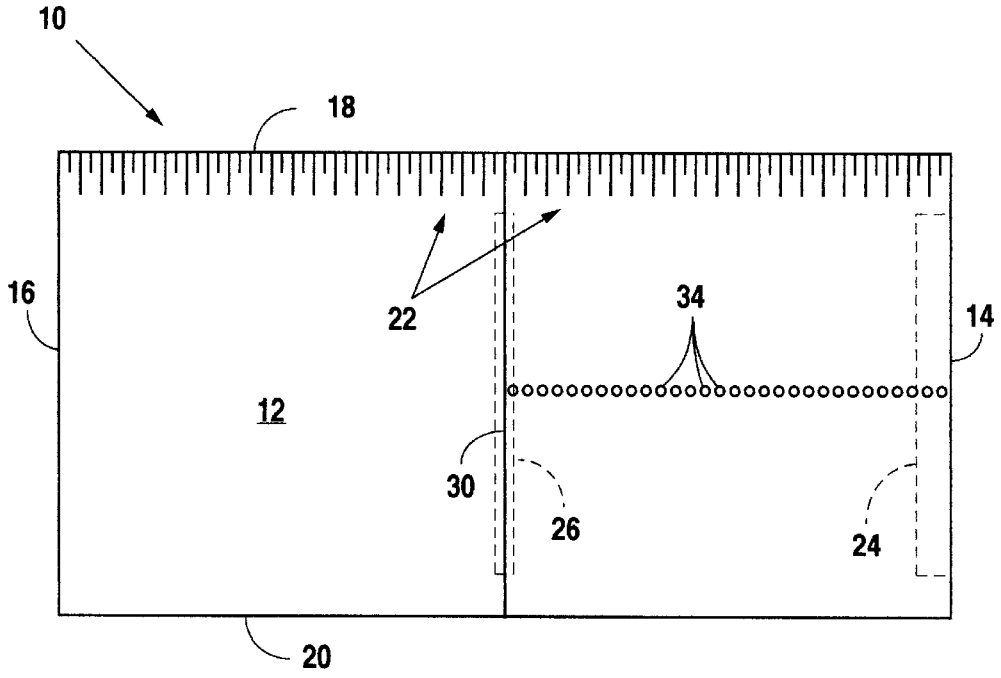
FIG. 1 is a top plan view of a preferred embodiment of the balance platform of the present invention.
Figure 2:
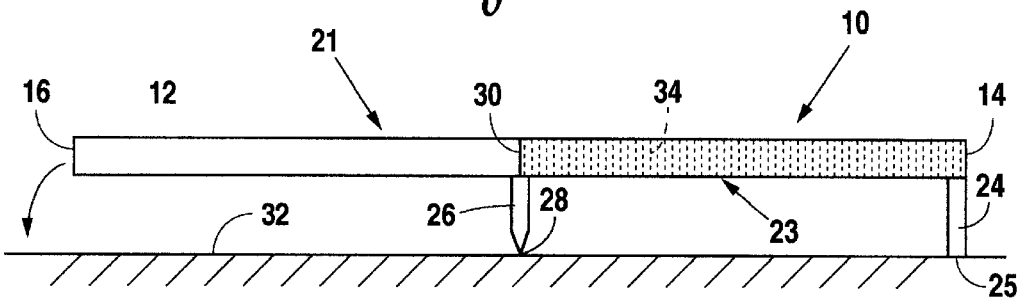
FIG. 2 is a side elevational view of the balance platform of FIG. 1.
Figure 3:
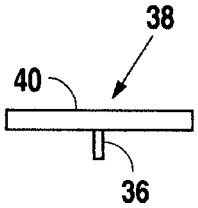
FIG. 3 is a side elevational view of a foot plate which may be used with the balance platform of the present invention illustrated in FIG. 1.

Referring to FIG. 1 and FIG. 2, the preferred embodiment of the balance platform of the present invention is identified by the number 10. The platform 10 comprises a generally rectangular, planar support surface 12 having a back or rear edge 14 and a front or forward edge 16. Support surface 12 has a pair of opposite side edges 18 and 20, at least one of which is calibrated as shown at 22. Each mark or calibration 22 represents, or is spaced at, approximately one-half inch (½"). Surface 12 has a top or upper side 21 and a bottom or underside 23.

Referring again to FIG. 1 and FIG. 2, the underside 23 of support surface 12 has a support leg 24 connected thereto at rear edge 14. Support leg 24 has a generally flat or planar bottom 25 and extends substantially across the width of surface 12. Also connected to the underside 23 of support surface 12 is a pivot leg 26 having a V-shaped end that has or defines an apex or pivot point 28. Pivot leg 26 and the V-shaped end thereof extend substantially across the width of surface 12. Pivot leg 26 is positioned immediately beneath the center of mass of the balance platform 10, identified by line 30. Center of mass line 30 is aligned with, and in the same plane with, apex 28 such that the fully constructed platform 10 is evenly balanced on leg 26. It is to be understood that with leg 24 on end 14, the center of mass will not be in the middle of surface 12. Legs 24 and 26 support surface 12 on the ground, a floor, or other appropriate surface 32.

Figure 4:
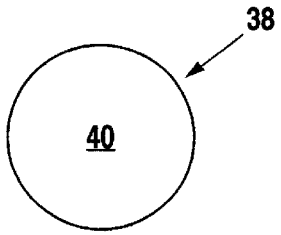
FIG. 4 is a top plan view of the foot plate of FIG. 3.

Referring to FIG. 1 and FIG. 4, surface 12 of the platform 10 preferably has a plurality of holes 34 therein or therethrough which have a diameter of approximately one-quarter inch (¼") and are spaced approximately one half inch (½") apart. Holes 34 are located in approximately the middle of surface 12 between line 30 and end 14. Each hole 34 is adapted to receive the stem 36 of a foot plate 38. Foot plate 38 has a circular head 40 with a diameter of approximately one inch (1"). As discussed below, positioning of the foot plate 38 within one of the holes 34 provides a visual cue to facilitate maintenance of a batter's rear foot at a desired position behind center of mass line 30.

Figure 5:
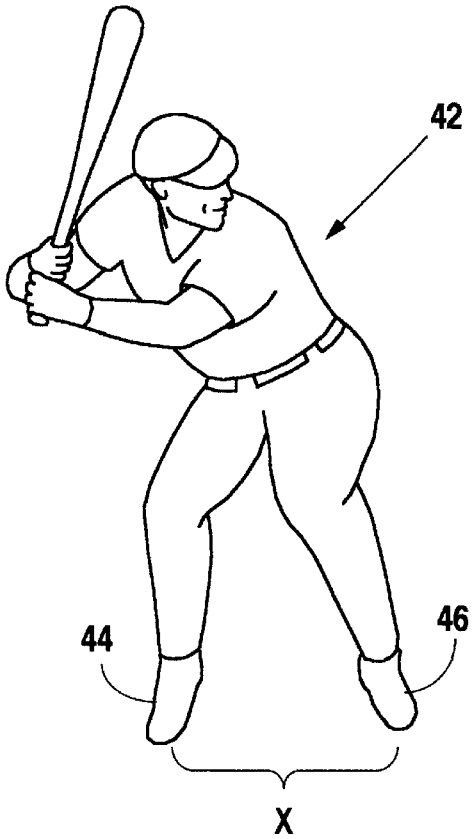
FIG. 5 is a side elevational view of a batter in a stance position.

Referring again to FIG. 1, FIG. 2, FIG. 5 and FIG. 6, the platform 10 may be used to teach or train a batter 42 to appropriately shift body weight during the stride phase of the batting swing or swing mechanics. First, the distance between the batter's rear foot 44 and front or stride foot 46, when the batter 42 is in a batting stance, is measured and identified as x, as illustrated in FIG. 5. The average length of the batter's stride is thereafter measured by having the batter 42 take several strides from a batting stance and the average distance or length between the position of the batter's front or stride foot 46 in the stance position (FIG. 5) and the position of the front or stride foot 46 once the stride is taken (FIG. 6) is measured and identified as y. This value y may be determined by subtracting x from the total stride length. Measurements of x and y are preferably taken from or with reference to the joint on the batter's "big" or medial toe. A desired or preselected percent body weight distribution on the stride foot 46 (at the end of the stride phase) is also determined or selected. For example, many batting instructors believe that a percent body weight distribution of approximately forty percent (40%) on the stride foot 46 at the end of the stride phase (FIG. 6) of the swing mechanics is desired.

Once the forgoing values are determined, the proper placement of the foot plate 38 is determined or calculated by the following equation:

$$d_B = P_F(X+Y)$$

Figure 6:
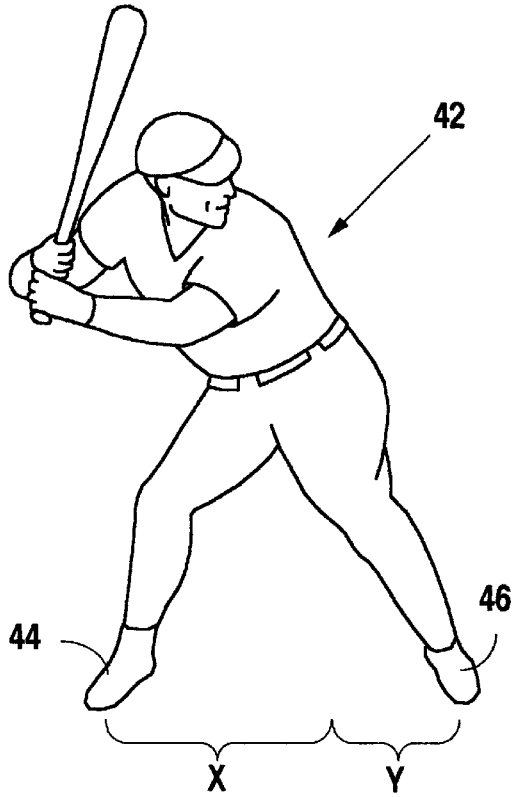
FIG. 6 is a side elevational view of a batter at the end of the stride phase.

In the foregoing equation, $d_b$ is the distance in inches behind the center of mass 30, $P_F$ is the desired or preselected percent body weight on the front or stride foot 46, x is the distance between the batter's feet in the batting stance (FIG. 5), and y is the batter's stride length (FIG. 6). For example, if the preselected body weight distribution on the stride foot is 40% for a batter whose feet are twenty-four inches (24") apart in the stance and has a stride of five inches (5") (on average), the placement of the foot plate 38 from the center of mass 30 is calculated as follows:

$$\begin{aligned} d_B &= .40\,(24\text{ in.}+5\text{ in.}) \\ &= .40\,(29\text{ in.}) \\ &= 11.6\text{ in.} \end{aligned}$$

Since the value of $d_B$ is rounded to the nearest one-half inch (½"), the foot plate 38 is positioned in the hole 34 at 11.5 inches behind the center of mass line 30. This is done by simply inserting the stem 36 into the appropriate hole 30 with head 40 supported atop surface 12 (head 40 having a larger diameter than hole 30). Such positioning of the foot plate 38 facilitates positioning of, and maintenance of, the batter's rear foot during usage of platform 10.

It is to be understood that any desired body weight distribution ($P_F$) may be used and that the position of the foot plate 38 may be calculated by the above formula or according to appropriate tables. Table A hereinbelow may be utilized for a $P_F$ of 40%. Table B hereinbelow may be utilized for a $P_F$ of 50%. In both tables, x values are along the vertical axis and y values are along the horizontal axis.

TABLE A $d_B$ values for $P_F$ = 40%

| | y | | | | | | | | |
|---|---|---|---|---|---|---|---|---|---|
| x | 0 | 1 | 2 | 3 | 4 | 5 | 6 | 7 | 8 |
| 12 | 4.8 | 5.2 | 5.6 | 6 | 6.4 | 6.8 | 7.2 | 7.6 | 8 |
| 13 | 5.2 | 5.6 | 6 | 6.4 | 6.8 | 7.2 | 7.6 | 8 | 8.4 |
| 14 | 5.6 | 6 | 6.4 | 6.8 | 7.2 | 7.6 | 8 | 8.4 | 8.8 |
| 15 | 6 | 6.4 | 6.8 | 7.2 | 7.6 | 8 | 8.4 | 8.8 | 9.2 |
| 16 | 6.4 | 6.8 | 7.2 | 7.6 | 8 | 8.4 | 8.8 | 9.2 | 9.6 |
| 17 | 6.8 | 7.2 | 7.6 | 8 | 8.4 | 8.8 | 9.2 | 9.6 | 10 |
| 18 | 7.2 | 7.6 | 8 | 8.4 | 8.8 | 9.2 | 9.6 | 10 | 10.4 |
| 19 | 7.6 | 8 | 8.4 | 8.8 | 9.2 | 9.6 | 10 | 10.4 | 10.8 |
| 20 | 8 | 8.4 | 8.8 | 9.2 | 9.6 | 10 | 10.4 | 10.8 | 11.2 |
| 21 | 8.4 | 8.8 | 9.2 | 9.6 | 10 | 10.4 | 10.8 | 11.2 | 11.6 |
| 22 | 8.8 | 9.2 | 9.6 | 10 | 10.4 | 10.8 | 11.2 | 11.6 | 12 |
| 23 | 9.2 | 9.6 | 10 | 10.4 | 10.8 | 11.2 | 11.6 | 12 | 12.4 |
| 24 | 9.6 | 10 | 10.4 | 10.8 | 11.2 | 11.6 | 12 | 12.4 | 12.8 |
| 25 | 10 | 10.4 | 10.8 | 11.2 | 11.6 | 12 | 12.4 | 12.8 | 13.2 |
| 26 | 10.4 | 10.8 | 11.2 | 11.6 | 12 | 12.4 | 12.8 | 13.2 | 13.6 |
| 27 | 10.8 | 11.2 | 11.6 | 12 | 12.4 | 12.8 | 13.2 | 13.6 | 14 |
| 28 | 11.2 | 11.6 | 12 | 12.4 | 12.8 | 13.2 | 13.6 | 14 | 14.4 |
| 29 | 11.6 | 12 | 12.4 | 12.8 | 13.2 | 13.6 | 14 | 14.4 | 14.8 |
| 31 | 12.4 | 12.4 | 13.2 | 13.6 | 14 | 14.4 | 14.8 | 15.2 | 15.6 |
| 32 | 12.8 | 13.2 | 13.6 | 14 | 14.4 | 14.8 | 15.2 | 15.6 | 16. |
| 33 | 13.2 | 14 | 14 | 14.4 | 14.8 | 15.2 | 15.6 | 16 | 16.4 |
| 34 | 13.6 | 14.4 | 14.4 | 14.8 | 15.2 | 15.6 | 16 | 16.4 | 16.8 |

$d_B = P_F(x + y)$

TABLE B $d_B$ values for $P_F$ = 50%

| | y | | | | | | | | |
|---|---|---|---|---|---|---|---|---|---|
| x | 0 | 1 | 2 | 3 | 4 | 5 | 6 | 7 | 8 |
| 12 | 6 | 6.5 | 7 | 7.5 | 8 | 8.5 | 9 | 9.5 | 10 |
| 13 | 6.5 | 7 | 7.5 | 8 | 8.5 | 9 | 9.5 | 10 | 10.5 |
| 14 | 7 | 7.5 | 8 | 8.5 | 9 | 9.5 | 10 | 10.5 | 11 |
| 15 | 7.5 | 8 | 8.5 | 9 | 9.5 | 10 | 10.5 | 11 | 11.5 |
| 16 | 8 | 8.5 | 9 | 9.5 | 10 | 10.5 | 11 | 11.5 | 12 |
| 17 | 8.5 | 9 | 9.5 | 10 | 10.5 | 11 | 11.5 | 12 | 12.5 |
| 18 | 9 | 9.5 | 10 | 10.5 | 11 | 11.5 | 12 | 12.5 | 13 |
| 19 | 9.5 | 10 | 10.5 | 11 | 11.5 | 12 | 12.5 | 13 | 13.5 |
| 20 | 10 | 10.5 | 11 | 11.5 | 12 | 12.5 | 13 | 13.5 | 14 |
| 21 | 10.5 | 11 | 11.5 | 12 | 12.5 | 13 | 13.5 | 14 | 14.5 |
| 22 | 11 | 11.5 | 12 | 12.5 | 13 | 13.5 | 14 | 14.5 | 15 |
| 23 | 11.5 | 12 | 12.5 | 13 | 13.5 | 14 | 14.5 | 15 | 15.5 |
| 24 | 12 | 12.5 | 13 | 13.5 | 14 | 14.5 | 15 | 15.5 | 16 |
| 25 | 12.5 | 13 | 13.5 | 14 | 14.5 | 15 | 15.5 | 16 | 16.5 |
| 26 | 13 | 13.5 | 14 | 14.5 | 15 | 15.5 | 16 | 16.5 | 17 |
| 27 | 13.5 | 14 | 14.5 | 15 | 15.5 | 16 | 16.5 | 17 | 17.5 |
| 28 | 14 | 14.5 | 15 | 15.5 | 16 | 16.5 | 17 | 17.5 | 18 |
| 29 | 14.5 | 15 | 15.5 | 16 | 16.5 | 17 | 17.5 | 18 | 18.5 |
| 31 | 15.5 | 16 | 16.5 | 17 | 17.5 | 18 | 18.5 | 19 | 19.5 |
| 32 | 16 | 16.5 | 17 | 17.5 | 18 | 18.5 | 19 | 19.5 | 20 |
| 33 | 16.5 | 17 | 17.5 | 18 | 18.5 | 19 | 19.5 | 20 | 20.5 |
| 34 | 17 | 17.5 | 18 | 18.5 | 19 | 19.5 | 20 | 20.5 | 21 |

$d_B = P_F(x + y)$

Once the foot plate 38 has been properly positioned, the batter 42 takes his or her stance atop the surface 12 with the rear foot 44 on foot plate 38 such that the "big" or medial toe of the foot 44 is over plate 40. Plate 40 thus provides a visual cue for placement of foot 44. The batter then takes his or her stride normally used in connection with a batting swing. Using the above example, the surface 12 will tilt when forty percent (40%) of the batter's body weight is exceeded on the front or stride foot 46. That is, if at the end of the stride phase (FIG. 6), more than 40% of his or her body weight is on the front foot 46, the platform 12 will pivot or tilt (as shown by the arrow in FIG. 2) about pivot point 28. If tilted or pivoted, the platform 10 can be readily returned to its level position (illustrated in FIG. 2) by pivoting about point 28 in the opposite direction. The batter continues to practice (repeat) the foregoing steps until the platform 10 does not tilt or pivot a majority of the times that the batter's stride is taken. That is, the batter repeatedly "strides" in an attempt to get as close as possible to tilting platform 10 without actually causing platform 10 to tilt.

Figure 7:
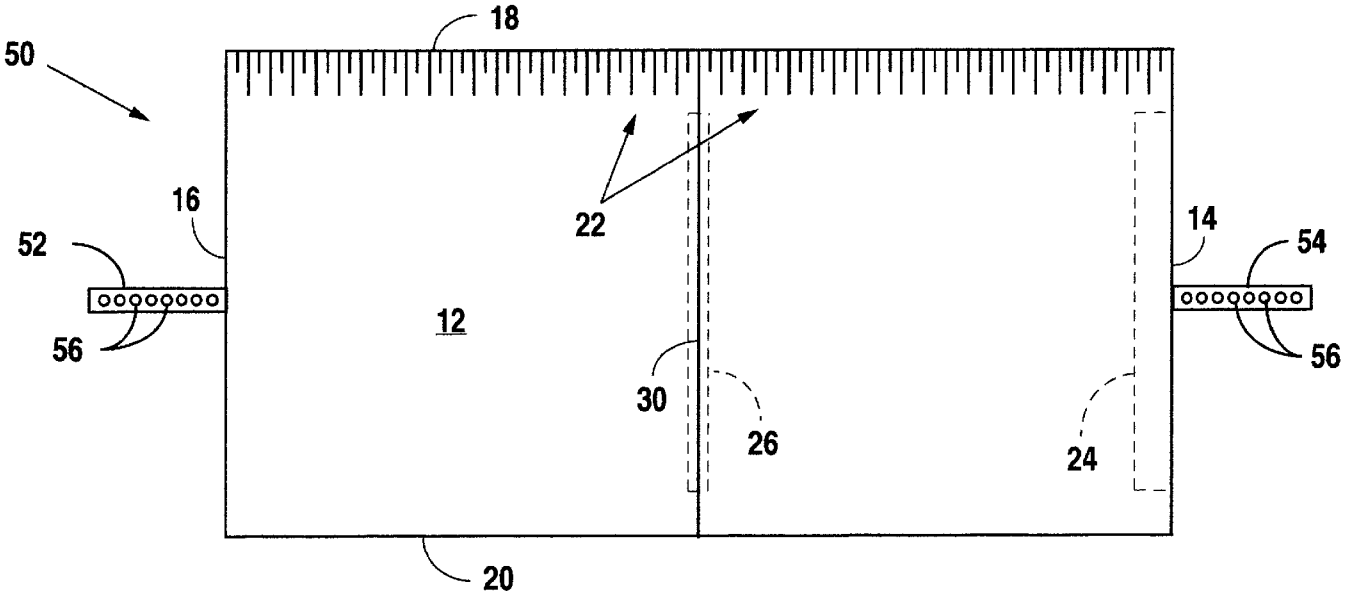
FIG. 7 is a top view of an alternate embodiment of the balance platform of the present invention.
Figure 8:
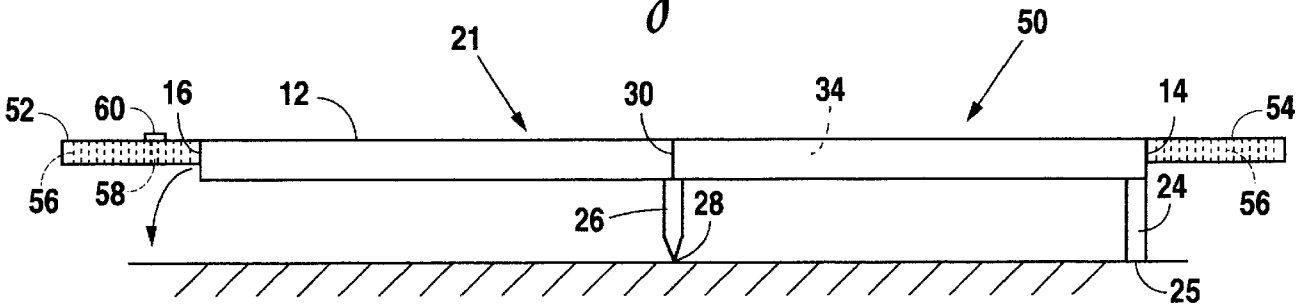
FIG. 8 is a side elevational view of the balance platform of FIG. 7.

Referring to FIG. 7 and FIG. 8, an alternate embodiment of the balance platform is identified by the number 50, with like numerals utilized to identify features or components identified in connection with platform 10. Center of mass line 30 (and the position of leg 26) are determined in the same manner as described in connection with embodiment 10 but may be in a different location along support 12 than in embodiment 10. A forward tongue 52 is connected to the forward edge 16 of surface 12 and rearward tongue 54 is connected to rearward surface 14 of surface 12. Tongues 52 and 54 are connected in approximately the center of edges 16 and 14, respectively, substantially perpendicular to line 30. Each tongue at 52 and 54 has a plurality of holes 56 therein or therethrough spaced a predetermined distance along the length of each tongue. Each hole 56 is adapted to receive the stem 58 of an adjustment weight 60. The insertion of stem 58 into the appropriate hole 56 retains adjustment weight 60 at the desired location along tongue 52 or 54 during usage of the platform 50.

The operation of embodiment 50, like embodiment 10, is a function of x, the stance distance between the batter's feet, the value of $P_F$ selected, and the batter's stride length y. The variables x and y are determined as described hereinabove. In addition, the operation of embodiment 50 is also a function of the batter's weight and requires the placement of adjustment weight 60 on tongues 52 or 54 at a calculated distance from the center of mass line 30 on the balance platform 50. The mathematical relationships among the parameters described above is summarized in the following equation:

$$Z = \frac{W(.5x - P_F(x + y))}{R}$$

WHERE: Z is the distance in inch units (in) that the adjustment weight 60 must be positioned from the center of mass line 30;

W is the weight of the batter expressed in pound units (lbs);

R is the weight in pound units (lbs) of the adjustment weight 60; and $P_F$, x, and y have the same meaning as previously described in connection with platform embodiment 10.

The following sample calculation illustrates the application of this equation to the specific situation of:

$P_F$=40%

W=200 lbs.

x=24 in.

y=4 in.

R=4 lbs.

Z is calculated as follows:

$$Z = \frac{W(.5x - P_F(x - y))}{R}$$

$$= \frac{200\ \text{lbs}((.5)(24) - (.40)(24\ \text{in} + 4\ \text{in}))}{4\ \text{lbs}}$$

-continued $$= 50(12\ \text{in} - 11.2\ \text{in}) = 50(8\ \text{in})$$

$$Z = 40\ \text{in.}$$

Thus, a four pound (4lb) adjustment weight must be placed on the tongue 52 at a distance of forty inches (40") from the center of mass line 30. In this configuration, the balance platform 50 is ready for use by a two hundred pound (200 lbs) batter. In doing so, the batter 42 assumes a normal hitting stance atop the balance platform 50 with each foot (44 and 46) equal distance from the center of mass line 30. In the foregoing example, this means that each foot 44 and 46 is twelve inches (12") from line 30. That is, the rear foot 44 and front foot 46 are placed on the opposite side of line 30 at a distance of one-half (½) of x from line 30. The batter then strides to test if he/she has stayed below forty percent (40%) body weight on the stride foot 46. If the batter's stride results in an excess of forty percent (40%) body weight on the stride foot at the end of the stride phase, the platform 50 will tilt or pivot, as illustrated by the arrow in FIG. 8.

If tilted or pivoted, the platform 50 can be readily returned to its level position (illustrated in FIG. 8) by pivoting about apex 28 in the opposite direction. The batter continues to practice (repeat) the foregoing steps until the platform 50 does not tilt or pivot a majority of the times that the batter's stride is taken. That is, the batter repeatedly "strides" in an attempt to get as close as possible to tilting platform 50 without actually causing platform 50 to tilt.

Tables C and D hereinbelow contain values of Z for $P_F$ values of 40% and 50%, respectively, for a 200 pound batter having various combinations of x and y values, the x values being on the vertical axis and the y values on the horizontal axis.

TABLE C

Z values for $P_F$ = 40%

| | y | | | | | | | | |
|---|---|---|---|---|---|---|---|---|---|
| x | 0 | 1 | 2 | 3 | 4 | 5 | 6 | 7 | 8 |
| 12 | 60 | 40 | 20 | 0 | −20 | −40 | −60 | −80 | −100 |
| 13 | 65 | 45 | 25 | 5 | −15 | −35 | −55 | −75 | −95 |
| 14 | 70 | 50 | 30 | 10 | −10 | −30 | −50 | −70 | −90 |
| 15 | 75 | 55 | 35 | 15 | −5 | −25 | 45 | −65 | −85 |
| 16 | 80 | 60 | 40 | 20 | 0 | −20 | −40 | −60 | −80 |
| 17 | 85 | 65 | 45 | 25 | 5 | −15 | −35 | −55 | −75 |
| 18 | 90 | 70 | 50 | 30 | 10 | −10 | −30 | −50 | −70 |
| 19 | 95 | 75 | 55 | 35 | 15 | −5 | −25 | −45 | −65 |
| 20 | 100 | 80 | 60 | 40 | 20 | 0 | −20 | 40 | −60 |
| 21 | 105 | 85 | 65 | 45 | 25 | 5 | −15 | −35 | −55 |
| 22 | 110 | 90 | 70 | 50 | 30 | 10 | −10 | −30 | −50 |
| 23 | 115 | 95 | 75 | 55 | 35 | 15 | −5 | −25 | 45 |
| 24 | 120 | 100 | 80 | 60 | 40 | 20 | 0 | −20 | −40 |
| 25 | 125 | 105 | 85 | 65 | 45 | 25 | 5 | −15 | −35 |
| 26 | 130 | 110 | 90 | 70 | 50 | 30 | 10 | −10 | −30 |
| 27 | 135 | 115 | 95 | 75 | 55 | 35 | 15 | −5 | −25 |
| 28 | 140 | 120 | 100 | 80 | 60 | 40 | 20 | 0 | −20 |
| 29 | 145 | 125 | 105 | 85 | 65 | 45 | 25 | 5 | −15 |
| 30 | 150 | 130 | 110 | 90 | 70 | 50 | 30 | 10 | −10 |
| 31 | 155 | 135 | 115 | 95 | 75 | 55 | 35 | 15 | −5 |
| 32 | 160 | 140 | 120 | 100 | 80 | 60 | 40 | 20 | 0 |
| 33 | 165 | 145 | 125 | 105 | 85 | 65 | 45 | 25 | 5 |
| 34 | 170 | 150 | 130 | 110 | 90 | 70 | 50 | 30 | 10 |

$$Z = \frac{W(.5x - P_F(x + y))}{R}$$

W = 200 lbs $P_F$ = 40%

R = 4 lbs

TABLE D

| | Z values for $P_F$ = 50% | | | | | | | | |
|---|---|---|---|---|---|---|---|---|---|
| | y | | | | | | | | |
| x | 0 | 1 | 2 | 3 | 4 | 5 | 6 | 7 | 8 |
| 12 | 0 | −25 | −50 | −75 | −100 | −125 | −150 | −175 | −200 |
| 13 | 0 | −25 | −50 | −75 | −100 | −125 | −150 | −175 | −200 |
| 14 | 0 | −25 | −50 | −75 | −100 | −125 | −150 | −175 | −200 |
| 15 | 0 | −25 | −50 | −75 | −100 | −125 | −150 | −175 | −200 |
| 16 | 0 | −25 | −50 | −75 | −100 | −125 | −150 | −175 | −200 |
| 17 | 0 | −25 | −50 | −75 | −100 | −125 | −150 | −175 | −200 |
| 18 | 0 | −25 | −50 | −75 | −100 | −125 | −150 | −175 | −200 |
| 19 | 0 | −25 | −50 | −75 | −100 | −125 | −150 | −175 | −200 |
| 20 | 0 | −25 | −50 | −75 | −100 | −125 | −150 | −175 | −200 |
| 21 | 0 | −25 | −50 | −75 | −100 | −125 | −150 | −175 | −200 |
| 22 | 0 | −25 | −50 | −75 | −100 | −125 | −150 | −175 | −200 |
| 23 | 0 | −25 | −50 | −75 | −100 | −125 | −150 | −175 | −200 |
| 24 | 0 | −25 | −50 | −75 | −100 | −125 | −150 | −175 | −200 |
| 25 | 0 | −25 | −50 | −75 | −100 | −125 | −150 | −175 | −200 |
| 26 | 0 | −25 | −50 | −75 | −100 | −125 | −150 | −175 | −200 |
| 27 | 0 | −25 | −50 | −75 | −100 | −125 | −150 | −175 | −200 |
| 28 | 0 | −25 | −50 | −75 | −100 | −125 | −150 | −175 | −200 |
| 29 | 0 | −25 | −50 | −75 | −100 | −125 | −150 | −175 | −200 |
| 30 | 0 | −25 | −50 | −75 | −100 | −125 | −150 | −175 | −200 |
| 31 | 0 | −25 | −50 | −75 | −100 | −125 | −150 | −175 | −200 |
| 32 | 0 | −25 | −50 | −75 | −100 | −125 | −150 | −175 | −200 |
| 33 | 0 | −25 | −50 | −75 | −100 | −125 | −150 | −175 | −200 |
| 34 | 0 | −25 | −50 | −75 | −100 | −125 | −150 | −175 | −200 |

$$Z = \frac{W(.5x - P_F(x + y))}{R}$$

W = 200 lbs
$P_F$ = 50%
R = 4 lbs

It is to be understood that positive values for Z require placement of weight 60 on forward tongue 52 and negative values for Z require placement of weight 60 on rearward tongue 54. Further, the calculated Z values will determine the appropriate length of tongues 52 and 54. Finally, it should be understood that a platform 50 may be utilized having only one tongue 52 or 54, depending upon the batter and variables selected.

In the preferred embodiment, the width of surface 12 (between edges 18 and 20) is approximately two feet (2') and the length of surface 12 (between edges 14 and 16) is approximately four feet (4'). That is, the width is approximately one-half of the length. The platforms 10 and 50 are preferably constructed of aluminum, with legs 24 and 26 connected to surface 12 by bolts, welding, or other means known in the art. Likewise, tongues 52 and 54 are bolted, welded, or otherwise secured to surface 12 by means known in the art. Platforms 10 and 50 may also be constructed of wood with legs 24 and 26 and tongues 52 and 54 screwed or nailed to surface 12. Weight 60 is preferably an integral or unitary piece of lead or other metal (having a known weight) and plate 38 is preferably an integral or unitary piece of aluminum or other metal or other lightweight material, such as plastic.

While the batting practice balance platform of the present invention has been described in connection with the preferred embodiment, it is not intended to limit the invention to the particular form set forth, but on the contrary, it is intended to cover such alternatives, modifications, and equivalents as may be included within the spirit and scope of the invention as defined by the appended claims.

I claim:

1. Apparatus for teaching desired weight shift of a batter during the stride phase associated with a batting swing, comprising a balance platform having a center of mass, said platform comprising a calibrated support surface for supporting said batter and facilitating placement of said batter's feet at a precalculated position atop said surface relative to said center of mass, a pivot leg beneath said support surface, and a support leg connected to said underside of said support surface at a rearward end of said support surface.

2. Apparatus for teaching desired weight shift of a batter during the stride phase associated with a batting swing, as recited in claim 1, further comprising apparatus for facilitating positioning of a rear foot of said batter at a predetermined position behind said center of mass.

3. Apparatus for teaching desired weight shift of a batter during the stride phase associated with a batting swing, as recited in claim 2, wherein said apparatus for facilitating positioning of a rear foot of said batter at a predetermined position behind said center of mass comprises a foot plate positionable in a hole within said support surface.

4. Apparatus for teaching desired weight shift of a batter during the stride phase associated with a batting swing, as recited in claim 1, wherein said support surface is generally rectangular and said pivot leg and said support leg extend substantially across the width of said support surface.

5. Apparatus for teaching desired weight shift of a batter during the stride phase associated with a batting swing, as recited in claim 1, wherein said pivot leg comprises a V-shaped lower end defining an apex about which said platform may pivot.

6. A method for teaching a batter to shift body weight during the stride phase associated with a batting swing to achieve a predetermined body weight distribution on said batter's stride foot, comprising the steps of:

measuring the stance distance of said batter;

measuring the average stride length of said batter;

determining from said stance distance and said average stride length a desired positioning of a rear foot of said batter on a balance platform having a center of mass;

positioning said batter on said balance platform such that said rear foot of said batter is positioned a precalculated distance behind said center of mass; and conducting a stride associated with said batting swing, said platform providing said batter with a kinesthetic signal when said batter's weight shift has resulted in a body weight distribution on said stride foot greater than said predetermined body weight distribution.

7. A method for teaching a batter to shift body weight during the stride phase associated with a batting swing, as recited in claim 6, wherein said step of determining a desired positioning of said rear foot of said batter on a balance platform comprises the step of calculating a distance for a rear foot of a batter from a center of mass of said platform using the following equation:

$$d_B = P_F(X+Y)$$

wherein $d_B$ is the distance behind said center of mass, $P_F$ is a preselected percent body weight on a front foot of said batter, x is said stance distance, and y is said average stride length.

8. A method for teaching a batter to shift body weight during the stride phase associated with a batting swing, as recited in claim 6, further comprising the step of placing a foot plate on said platform at said desired position of said rear foot of said batter.

9. A method for teaching a batter to shift body weight during the stride phase associated with a batting swing, as recited in claim 8, wherein said step of placing a foot plate on said platform comprises the step of inserting a stem of said foot plate into a hole in said platform at said predetermined distance behind said center of mass.

10. A method for teaching a batter to shift body weight during the stride phase associated with a batting swing to achieve a precalculated body weight distribution on batter's stride foot, comprising the steps of:

measuring the stance distance of said batter;

measuring the average stride length of said batter;

determining from said stance distance and said average stride length the desired positioning of a rear foot of said batter on a balance platform comprising the step of calculating a distance for said rear foot of said batter from a center of mass of said platform using the following equation:

$$d_B = P_F\,(X+y)$$

wherein $d_B$ is the distance behind said center of mass, $P_F$ is a preselected percent body weight on a front foot of said batter, x is said stride distance and y is said average stride length;

placing a visual cue on said platform at said desired position of said rear foot of said batter;

positioning said batter on said balance platform such that rear foot of said batter is positioned atop of said visual cue; and conducting a stride associated with said batting swing, said platform providing said batter with a kinesthetic signal when said batter's weight shift has resulted in a body weight distribution on said stride foot greater than said predetermined body weight distribution.

11. Apparatus for teaching desired weight shift of a batter during the stride phase associated with a batting swing, comprising a balance platform having a center of mass, said platform comprising a support surface for supporting said batter and facilitating placement of said batter's feet at a precalculated position atop said surface relative to said center of mass, a pivot leg connected to an underside of said support surface, and a support leg connected to said underside of said support surface at a rearward end of said support surface, said platform further comprising at least one tongue connected to an end of said support surface for receiving thereon an adjustment weight.

12. Apparatus for teaching desired weight shift of a batter during the stride phase associated with a batting swing, as recited in claim 11, wherein said support surface is generally rectangular and said pivot leg and support leg extends substantially across the width of said support surface.

13. Apparatus for teaching desired weight shift of a batter during the stride phase associated with a batting swing, as recited in claim 11, wherein said pivot leg comprises a V-shaped lower end defining an apex about which said platform may pivot.

14. Apparatus for teaching desired weight shift of a batter during the stride phase associated with a batting swing, as recited in claim 11, wherein said platform comprises a first tongue on a forward end thereof and a second tongue on a rearward end thereof.

15. Apparatus for teaching desired weight shift of a batter during the stride phase associated with a batting swing, comprising a balance platform having a center of mass, said platform comprising a support surface, a pivot leg connected to an underside of said support surface, and a support leg connected to said underside of said support surface at a rearward end of said support surface, said platform further comprising a first tongue connected to a forward end of said support surface and a second tongue connected to a rearward end of said support surface for receiving thereon an adjustment weight, wherein said first tongue and said second tongue have a plurality of holes therein for receiving a stem of said adjustment weight.

16. A method for teaching a batter to shift body weight during the stride phase associated with a batting swing to achieve a precalculated body weight distribution on said batter's stride foot, comprising the steps of:

measuring the stance distance of a batter;

measuring the average stride length of said batter;

measuring the weight of said batter;

determining from said stance distance, said average stride length, and said batter's weight, a desired positioning of an adjustment weight on a tongue of a balance platform;

positioning said adjustment weight on said tongue;

positioning said batter on said balance platform, having a center of mass, such that a rear foot and a front foot of said batter are positioned approximately equidistant from said center of mass; and conducting a stride associated with said batting swing, said platform providing said batter with a kinesthetic signal when said batter's weight shift has resulted in a body weight distribution on said stride foot greater than said predetermined body weight distribution.

17. A method for teaching a batter to shift body weight during the stride phase associated with a batting swing, as recited in claim 16, wherein said step of determining said desired positioning of said adjustment weight on said tongue of said balance platform comprises the step of calculating a distance for said adjustment weight from said center of mass of said platform using the following equation:

$$Z = \frac{W(.5x - P_F(x+y))}{R}$$

wherein Z is the distance that said adjustment weight must be positioned from said center of mass, W is the weight of said batter, R is the weight of said adjustment weight, $P_F$ is said preselected body weight distribution on said stride foot at the end of said stride phase, x is stance distance between the batter's feet, and y is said average stride length.

18. A method for teaching a batter to shift body weight during the stride phase associated with a batting swing, as recited in claim 16, wherein said step of positioning said adjustment weight on said tongue comprises the step of measuring a calculated distance from said center of mass to a position on said tongue.

19. A method for teaching a batter to shift body weight during the stride phase associated with a batting swing, as recited in claim 16, wherein said step of positioning said adjustment weight on said tongue comprises the step of inserting a stem of said weight in a hole in said tongue at a predetermined distance from said center of mass of said platform.

20. A method for teaching a batter to shift body weight during the stride phase associated with a batting swing, as recited in claim 16, wherein said step of determining a desired positioning of an adjustment weight on said tongue of said balance platform comprises the step of locating a desired distance based on a chart having stance distance values along one axis and average stride length values along a perpendicular axis.

* * * * *